US006394178B1

(12) United States Patent
Yoshida et al.

(10) Patent No.: US 6,394,178 B1
(45) Date of Patent: May 28, 2002

(54) PLATE TYPE HEAT EXCHANGER

(75) Inventors: Kaori Yoshida; Takeshi Ebisu; Eisaku Okubo; Katsuhiko Yamada, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/622,060

(22) PCT Filed: Feb. 19, 1999

(86) PCT No.: PCT/JP99/00731

§ 371 (c)(1),
(2), (4) Date: Aug. 25, 2000

(87) PCT Pub. No.: WO99/44003

PCT Pub. Date: Sep. 2, 1999

(30) Foreign Application Priority Data

Feb. 27, 1998 (JP) ..... 10-047152

(51) Int. Cl.[7] ..... F28F 3/08
(52) U.S. Cl. ..... 165/167; 165/166; 165/DIG. 368
(58) Field of Search ..... 165/166, 167, 165/DIG. 363, DIG. 360, DIG. 364, DIG. 368, DIG. 372, DIG. 373

(56) References Cited

U.S. PATENT DOCUMENTS

| | | | | | |
|---|---|---|---|---|---|
| 3,179,165 | A | * | 4/1965 | Usher et al. | 165/167 |
| 4,781,248 | A | * | 11/1988 | Pfeiffer | 165/167 |
| 4,911,235 | A | * | 3/1990 | Andersson et al. | 165/167 |
| 6,073,687 | A | * | 6/2000 | Jensen et al. | 165/167 |

FOREIGN PATENT DOCUMENTS

| | | |
|---|---|---|
| JP | 53-55545 | 5/1978 |
| JP | 61-83882 | 4/1986 |
| JP | 62-18867 | 5/1987 |
| JP | 4-1278 | 1/1992 |
| JP | 4-78914 | 12/1992 |
| JP | 6-109394 | 4/1994 |
| JP | 6-241672 | 9/1994 |
| JP | 7-236967 | 9/1995 |
| JP | 58-40074 | 10/1998 |

OTHER PUBLICATIONS

Obana, H., "The Heat Exchanger Design Handbook", pp. 635–636, Jul. 1977, Partial English Translation.

* cited by examiner

*Primary Examiner*—Henry Bennett
*Assistant Examiner*—Terrell McKinnon
(74) *Attorney, Agent, or Firm*—Nixon Peabody LLP; Donald R. Studebaker

(57) ABSTRACT

A plate-type heat exchanger is constructed by piling a plurality of heat transfer plates (P3) having an aspect ratio (=(longitudinal length (Y))/(lateral length (X))) of 1.5. The heat transfer plate (P3) is formed of a substantially planar plate in rectangular shape and has wave-shaped heat transfer enhancement surfaces (20*a*), (30*a*) formed on its surfaces. The four corners of the heat transfer plate, i.e., the lower left corner, the upper right corner, the upper left corner and the lower right corner, are formed with a first opening (21*a*) as an inlet of a first flow channel, a second opening (22*a*) as an outlet of the first flow channel, a third opening (23*a*) as an inlet of a second flow channel and a fourth opening (24*a*) as an outlet of the second flow channel, respectively. Around the openings (21*a*) through (24*a*), respective seals (12*a*) through (15*a*) are provided to rise toward the front side or the back side of the heat transfer plate. Each of the seals (12*a*) through (15*a*) is provided with a plurality of ribs (51) through (57) for suppressing a drift of refrigerant in the flow channel.

6 Claims, 10 Drawing Sheets

PLATE TYPE HEAT EXCHANGER

TECHNICAL FIELD

This invention relates to a plate-type heat exchanger, and particularly relates to measures for reducing a pressure loss of a fluid.

BACKGROUND ART

Various kinds of heat exchangers have conventionally been used in air conditioning systems, refrigerating systems, chilling systems and the like. Out of these heat exchangers, for example, a plate-type heat exchanger is known as a compact heat exchanger having a large coefficient of overall heat transmission as disclosed in "Shin-ban, Dai 4-han, Reito Kucho Binran (Ohyo-hen)" pp. 82, edited by Japan Society of Refrigerating and Air Conditioning Engineers.

As shown in FIG. 10, the plate-type heat exchanger is constructed so that a plurality of heat transfer plates (p), (p), . . . are piled one after another between two frames (f1), (f2).

Each of the heat transfer plates (p) is formed of a planar metal plate. The periphery of the heat transfer plate (p) engages the peripheries of the adjacent heat transfer plates (p) and the engagement portions are joined together by brazing. This provides an integral structure of the plurality of heat transfer plates (p). A first flow channel (a1) and a second flow channel (b1) are alternately formed in respective spaces between the adjacent heat transfer plates (p).

Four corners of each heat transfer plate (p) are provided with respective openings (a), (b), (c), (d) forming an inlet or outlet of the first flow channel (a1) or an inlet or outlet of the second flow channel (b1). By providing seals (e) surrounding the respective openings (a), (b), (c), (d), a first inflow space (a2) and a first outflow space (a3) each communicating with the first flow channel (a1) alone and a second inflow space (b2) and a second outflow space (b3) each communicating with the second flow channel (b1) alone are formed. The first fluid flows through the flow channel (a1) as shown in solid arrows in FIG. 10, the second fluid flows through the flow channel (b1) as shown in broken arrows in FIG. 10, and the first and second fluids heat-exchanges with each other via the heat transfer plates (p).

Problems that the Invention is to Solve

The conventional plate-type heat exchanges have used so-called longitudinally elongated heat transfer plates (p), i.e., heat transfer plates (p) having their longitudinal length considerably greater than their lateral length. In other words, conventionally, heat transfer plates (p) having a large ratio of the longitudinal length to the lateral length, i.e., a large aspect ratio, have been used.

However, the flow channel (a1), (b1) formed by the heat transfer plates (p) of large aspect ratio has a large channel length. Therefore, such conventional plate-type heat exchangers have caused large pressure losses of the fluid in the flow channel (a1), (b1).

Particularly in the case of using a fluid such as fluorocarbon refrigerant involving a phase change during heat exchange, a pressure loss in the flow channel becomes larger as compared with the case of using a fluid such as water in a single phase. The reason for this is that a two-phase flow has a larger pressure loss per unit flow rate than a single-phase flow. Accordingly, a large driving force has been required in order to pass such a two-phase refrigerant through the flow channel.

In addition, such a refrigerant decreases its temperature with decrease in its pressure. Therefore, if the pressure loss of the refrigerant is large, temperature profile in the heat exchanger becomes large in a flowing direction of the fluid. This invites a problem of decreasing a heat exchanger effectiveness.

Depending upon the type of apparatus in which the plate-type heat exchanger is mounted, for example, the type of air conditioner, a severe constraint may be placed on pressure loss in the flow channel. In such a case, conventionally, the number of heat transfer plates is increased to decrease the flow rate of refrigerant per flow channel thereby decreasing a pressure loss. Such a method, however, necessities a large number of heat transfer plates, which invites rise in cost of the air conditioner.

The present invention has been made in view of the above problems and therefore has its object of providing a plate-type heat exchanger having a small pressure loss of a fluid at low cost.

DISCLOSURE OF INVENTION

Summary of the Invention

To attain the above object, in the present invention, the aspect ratio of the heat transfer plate is decreased so that the channel length is decreased without decreasing its heat transfer area.

Means of Solving the Problems

More specifically, a plate-type heat exchanger according to the present invention in which a first flow channel (A) or a second flow channel (B) is formed between adjacent two of plural piled heat transfer plates (P1, P2; P3, P4), the first and second flow channels (A, B) allow respective first and second fluids to flow therethrough in a longitudinal direction of the heat transfer plate (P1, P2; P3, P4) and the first and second fluids are heat-exchanged with each other via the heat transfer plates (P1, P2; P3, P4), is characterized in that each of the heat transfer plates (P1, P2; P3, P4) is formed so that a longitudinal length (L) thereof is equal to or smaller than two times a lateral length (W) thereof.

Each of the heat transfer plates (P1, P2; P3, P4) may be formed so that the longitudinal length (L) thereof is not smaller than the lateral length (W) thereof and not larger than two times the lateral length (W).

Around an inlet (21*a*, 21*b*, 23*a*, 23*b*) of the at least one flow channel (A, B) formed in each of the heat transfer plates (P1, P2, P3, P4), a drift suppressing rib set (50*a*, 50*b*, 60*a*, 60*b*) including a plurality of ribs (51 through 58) may be formed to introduce the fluid from the inlet (21*a*, 21*b*, 23*a*, 23*b*) uniformly into the flow channel (A, B).

Each of the heat transfer plates (P1, P2; P3, P4) may be provided with an inlet (21*a*, 21*b*) and an outlet (22*a*, 22*b*) of the first flow channel (A) at respective ends in a longitudinal direction (Y) of the heat transfer plate (P1, P2; P3, P4) and provided with an inlet (23*a*, 23*b*) and an outlet (24*a*, 24*b*) of the second flow channel (B) at respective other ends in the longitudinal direction (Y) of the heat transfer plate (P1, P2; P3, P4), a primary heat transfer enhancement surface (20*a*, 20*b*) for enhancing heat exchange by giving disturbance to the flow of each fluid may be formed at least between the inlet (21*a*, 21*b*, 23*a*, 23*b*) and the outlet (22*a*, 22*b*, 24*a*, 24*b*) of each of the flow channels (A, B) of the heat transfer plate (P1, P2; P3, P4), and the longitudinal length of the primary heat transfer enhancement surface (20*a*, 20*b*) may be equal to or smaller than two times the lateral length thereof.

The inlet (21*a*, 21*b*) and the outlet (22*a*, 22*b*) of the first flow channel (A) may be provided in cater-cornered opposite positions of the heat transfer plate (P1, P2; P3, P4), and the inlet (23*a*, 23*b*) and the outlet (24*a*, 24*b*) of the second flow channel (B) may be provided in another cater-cornered opposite positions of the heat transfer plate (P1, P2; P3, P4).

The inlet (21*a*, 21*b*) and the outlet (22*a*, 22*b*) of the first flow channel (A) may be provided in cater-cornered opposite positions of the heat transfer plate (P1, P2; P3, P4), the inlet (23*a*, 23*b*) and the outlet (24*a*, 24*b*) of the second flow channel (B) maybe provided in another cater-cornered opposite positions of the heat transfer plate (P1, P2; P3, P4), and each of the heat transfer plates (P1, P2; P3, P4) may be provided with: seals (12*a* through 15*b*), formed to surround the inlet (21*a*, 21*b*, 23*a*, 23*b*) and the outlet (22*a*, 22*b*, 24*a*, 24*b*) of each of the flow channels (A, B) and rise on the front side or back side of the heat transfer plate (P1, P2; P3, P4), for preventing the first and second fluids from flowing into the second flow channel (B) and the first flow channel (A), respectively, by engaging one of the adjacent heat transfer plates (P1, P2; P3, P4); a primary heat transfer enhancement surface (20*a*, 20*b*) formed in a longitudinal midportion of the heat transfer plate (P1, P2; P3, P4), for enhancing heat exchange by giving disturbance to the flow of each fluid vertically flowing on the heat transfer plate (P1, P2; P3, P4); and an auxiliary heat transfer enhancement surface (30*a*, 30*b*), formed between the seals (12*a* through 15*b*) of the heat transfer plate (P1, P2; P3, P4) and the primary heat transfer enhancement surface (20*a*, 20*b*), for enhancing heat exchange by giving disturbance to the flow of the fluid diverging from the inlet (21*a*, 21*b*, 23*a*, 23*b*) toward the primary heat transfer enhancement surface (20*a*, 20*b*) or the flow of the fluid converging from the primary heat transfer enhancement surface (20*a*, 20*b*) toward the outlet (22*a*, 22*b*, 24*a*, 24*b*).

The inlet (21*a*, 21*b*) and the outlet (22*a*, 22*b*) of the first flow channel (A) may be provided in cater-cornered opposite positions of the heat transfer plate (P1, P2; P3, P4), the inlet (23*a*, 23*b*) and the outlet (24*a*, 24*b*) of the second flow channel (B) maybe provided in another cater-cornered opposite positions of the heat transfer plate (P1, P2; P3, P4), and each of the heat transfer plates (P1, P2; P3, P4) may be provided with: seals (12*a* through 15*b*), formed to surround the inlet (21*a*, 21*b*, 23*a*, 23*b*) and the outlet (22*a*, 22*b*, 24*a*, 24*b*) of each of the flow channels (A, B) and rise on the front side or back side of the heat transfer plate (P1, P2; P3, P4), for preventing the first and second fluids from flowing into the second flow channel (B) and the first flow channel (A), respectively by engaging one of the adjacent heat transfer plates (P1, P2; P3, P4); a primary heat transfer enhancement surface (20*a*, 20*b*), formed in a longitudinal midportion of the heat transfer plate (P1, P2; P3, P4), for enhancing heat exchange by giving disturbance to the flow of each fluid vertically flowing on the heat transfer plate (P1, P2; P3, P4); an auxiliary heat transfer enhancement surface (30*a*, 30*b*), formed between the seals (12*a* through 15*b*) of the heat transfer plate (P1, P2; P3, P4) and the primary heat transfer enhancement surface (20*a*, 20*b*), for enhancing heat exchange by giving disturbance to the flow of the fluid diverging from the inlet (21*a*, 21*b*, 23*a*, 23*b*) toward the primary heat transfer enhancement surface (20*a*, 20*b*) or the flow of the fluid converging from the primary heat transfer enhancement surface (20*a*, 20*b*) toward the outlet (22*a*, 22*b*, 24*a*, 24*b*); and a plurality of ribs (51 through 58), formed around each of the inlets (21*a*, 21*b*, 23*a*, 23*b*), for introducing the fluid flowing from each of the inlets (21*a*, 21*b*, 23*a*, 23*b*) uniformly in respective predetermined directions.

The plurality of ribs (51 through 58) may be arranged at irregular intervals so that an interval between the ribs (53 through 56) intermediate the ends of the rib set is narrower than that between the ribs (51, 52, 57, 58) closer to the ends of the rib set.

The plurality of ribs (51 through 58) may be formed so that the rib (53 through 56) intermediate the ends of the rib set is broader than the rib (51, 52, 57, 58) closer to the ends of the rib set.

The plurality of ribs (51 through 58) may be arranged substantially radially in the flow channel (A, B) downstream from the inlet (21*a*, 21*b*, 23*a*, 23*b*) and the length of the rib (51, 52, 57, 58) closer to the ends of the rib set may be larger than that of the rib (53 through 56) intermediate the ends of the rib set.

The plurality of ribs (51 through 58) may be arranged substantially radially in the flow channel (A, B) downstream from the inlet (21*a*, 21*b*, 23*a*, 23*b*) and the length of the rib (51, 52, 57, 58) closer to the ends of the rib set may be smaller than that of the rib (53 through 56) intermediate to the ends of the rib set.

At least one of the first fluid flowing through the first flow channel (A) and the second fluid flowing through the second flow channel (B) may be a fluid for providing heat exchange involving a phase change.

Operations

When the aspect ratio is decreased, the width of the flow channel (A, B) is increased but the length thereof is decreased. As a result, the channel length can be decreased without decreasing the heat transfer area. Therefore, without increasing the number of heat transfer plates, a pressure loss of each fluid can be decreased while maintaining the amount of heat exchange.

When the aspect ratio is set at a value of between 1 and 2, a drift due to increase in lateral length (W) can be suppressed and a suitable aspect ratio having a small pressure loss of the fluid can be obtained.

Furthermore, since a drift can be suppressed by the plurality of ribs (51 through 58), the fluid uniformly flows through the flow channel (A, B).

Moreover, the first fluid in the first flow channel (A) and the second fluid in the second flow channel (B) flows through the respective flow channels (A, B) along the diagonal of the heat transfer plate (P1, P2; P3, P4). Therefore, even if the aspect ratio is small, the fluid can flow relatively uniformly through the flow channel (A, B).

Further, since the flow is disturbed in the primary heat transfer enhancement surface (20*a*, 20*b*) and the auxiliary heat transfer enhancement surface (30*a*, 30*b*), heat exchange can be enhanced. It is to be noted that though the fluid tends to increase its pressure loss due to the disturbance of flow, a pressure loss of the fluid in the primary heat transfer enhancement surface (20*a*, 20*b*) can be decreased by setting the longitudinal length of the primary heat transfer enhancement surface (20*a*, 20*b*) at a value equal to or smaller than two times the lateral length thereof. Accordingly, heat exchange can be enhanced without largely increasing the pressure loss.

Furthermore, the plurality of ribs (51 through 58) are arranged at irregular intervals. At intermediate locations of the rib set where the fluid is essentially easy to flow, the flow of fluid is suppressed since the interval between the ribs (53 through 56) is narrow. On the other hand, at the ends of the rib set where the fluid is essentially hard to flow, the flow of fluid is accelerated since the interval between the ribs (51, 52, 57, 58) is broad. As a result, the fluid can flow uniformly through the entire flow channel and a drift can securely be prevented.

Moreover, when the fluid performing heat exchange involving a phase change flows, the effect of decreasing pressure loss in the flow channel can be more extensively exerted since such fluid has a property of a relatively large pressure loss.

Effects

According to the present invention, the length of the flow channel can be decreased without decreasing the heat transfer area. Therefore, a pressure loss of the fluid can be decreased without increasing the number of heat transfer plates. This makes it possible to construct a heat exchanger having a small pressure loss at low cost.

Further, if the aspect ratio is set at a value of between 1 and 2, there can be obtained a heat transfer plate suitable for decreasing a pressure loss while suppressing a drift of the fluid.

Furthermore, since the plurality of ribs prevents a drift of the fluid, increase in drift due to decrease in aspect ratio can be suppressed.

Moreover, since each fluid flows along the diagonal of the heat transfer plate, the fluid is allowed to flow relatively uniformly in the flow channel. Since the flow of each fluid is disturbed in the primary heat transfer enhancement surface and the auxiliary heat transfer enhancement surface, heat exchange can be enhanced. If the primary heat transfer enhancement surface is formed so that the longitudinal length thereof is equal to or smaller than two times the lateral length thereof, the amount of heat exchange can be increased while suppressing a pressure loss of the fluid at a small value.

Further, the drift suppressing rib set is arranged at irregular intervals. Therefore, at intermediate locations of the rib set where the fluid is essentially easy to flow, the flow of the fluid can be suppressed since the interval between the ribs located therein is narrow. On the other hand, at the ends of the rib set where the fluid is essentially hard to flow, the flow of the fluid can be accelerated since the interval between the ribs located therein is broad. Accordingly, the fluid can flow uniformly through the entire flow channel. This makes it possible to prevent a drift with reliability.

Furthermore, when the fluid providing heat exchange involving a phase change is used, the above-mentioned effect of decreasing a pressure loss in the flow channel can be exerted more remarkably.

BEST MODE FOR CARRYING OUT THE INVENTION

Hereinafter, embodiments of the present invention will be described with reference to the drawings.

EMBODIMENT 1

Structure of Plate-type Heat Exchanger (1)

Figure 1:
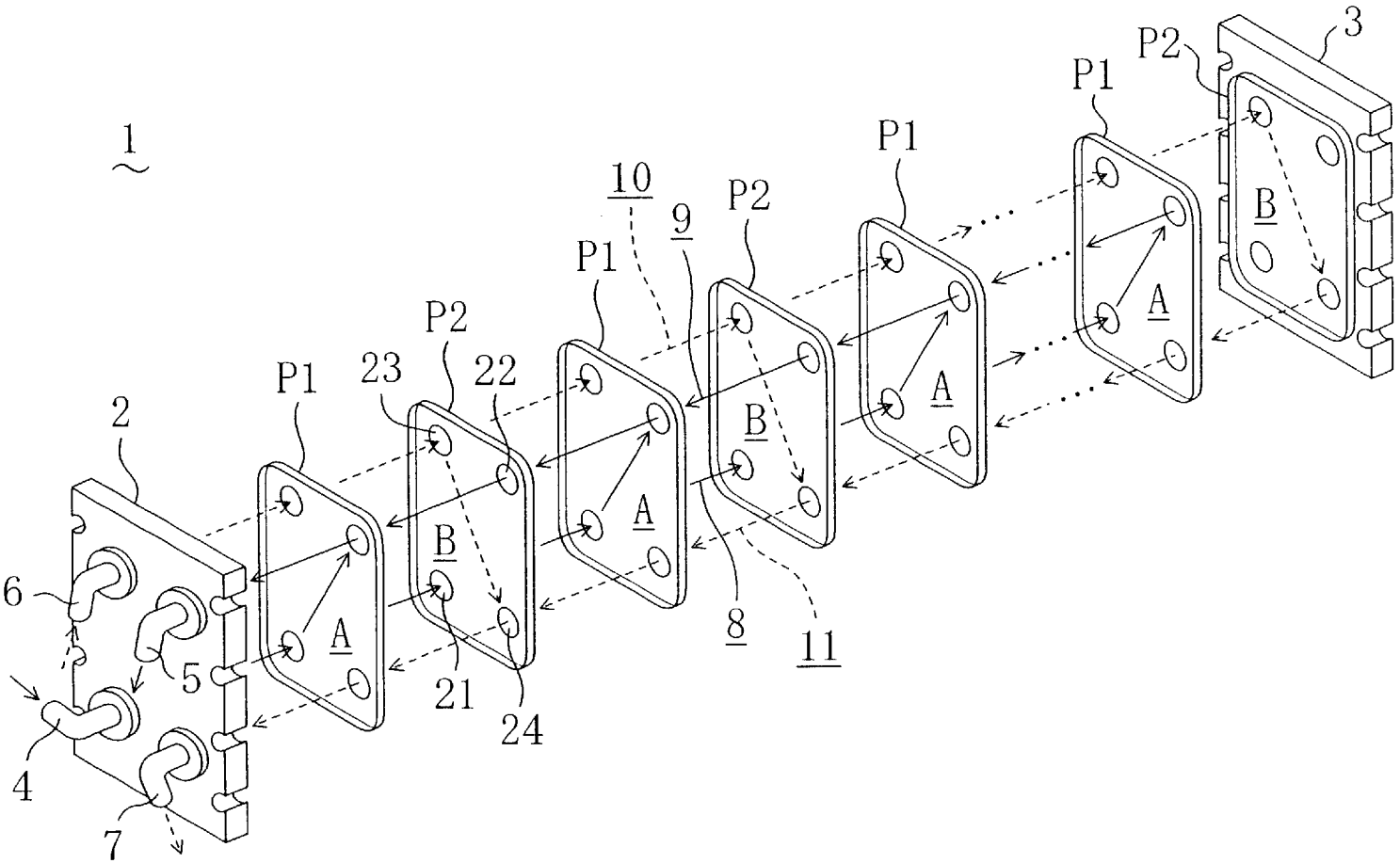
FIG. 1 is an exploded perspective view of a plate-type heat exchanger.

As shown in the exploded perspective view of FIG. 1, a plate-type heat exchanger (1) of this embodiment is constructed so that a plurality of heat transfer plates (P1), (P2) of two types are alternately piled between two frames (2), (3) and integrally joined together by brazing. Between the two frames, a first flow channel (A) through which a first fluid flows and a second flow channel (B) through which a second fluid flows are alternately and repeatedly formed in a manner to be provided between the adjacent heat transfer plates (P1), (P2). In FIG. 1, illustration of wave-shaped parts forming a heat transfer enhancement surface (20*a*), (20*b*), seals (12*a*), (12*b*) and the like (see FIGS. 2 and 3) which will be described later is omitted.

In the first frame (2) located at the foremost position in FIG. 1, its four corners, i.e., the lower left corner, the upper right corner, the upper left corner and the lower right corner, are connected to a first inlet pipe (4) as an inlet pipe for the first fluid, a first outlet pipe (5) as an outlet pipe for the first fluid, a second inlet pipe (6) as an inlet pipe for the second fluid and a second outlet pipe (7) as an outlet pipe for the second fluid, respectively.

Each of the first heat transfer plate (P1) and the second heat transfer plate (P2) is formed with a first opening (21), a second opening (22), a third opening (23) and a fourth opening (24) at the corresponding positions of the first inlet pipe (4), the first outlet pipe (5), the second inlet pipe (6) and the second outlet pipe (7), respectively. The first opening (21), the second opening (22), the third opening (23) and the fourth opening (24) constitute an inlet of the first flow channel (A), an outlet of the first flow channel (A), an inlet of the second flow channel (B) and an outlet of the second flow channel (B), respectively. Further, when the plurality of first heat transfer plates (P1) and the plurality of second heat transfer plates (P2) are alternately piled, a first inflow space (8), a first outflow space (9), a second inflow space (10) and a second outflow space (11) are defined by the first opening (21), the second opening (22), the third opening (23) and the fourth opening (24), respectively.

Figure 2:
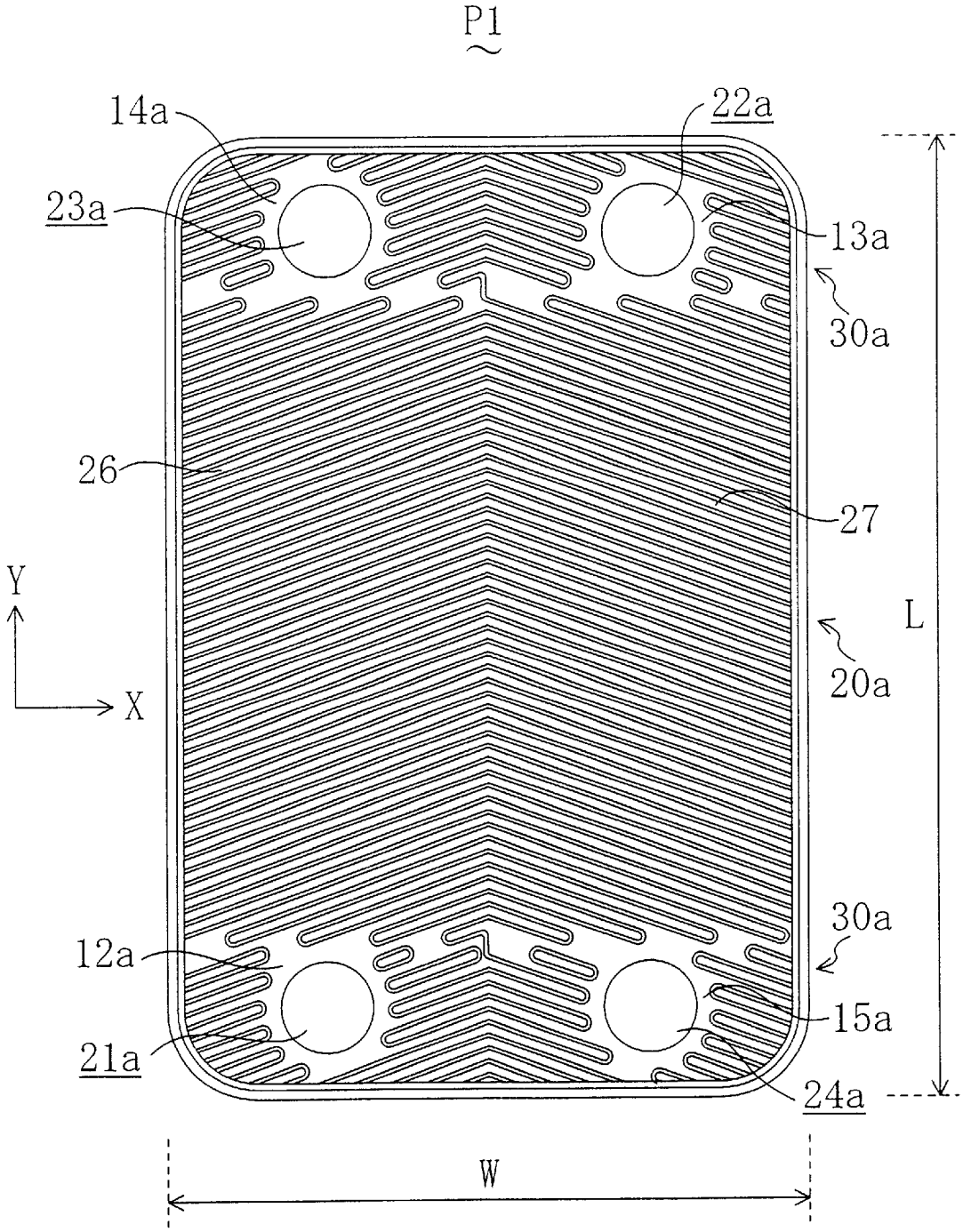
FIG. 2 is a front view of a first heat transfer plate according to Embodiment 1.
Figure 3:
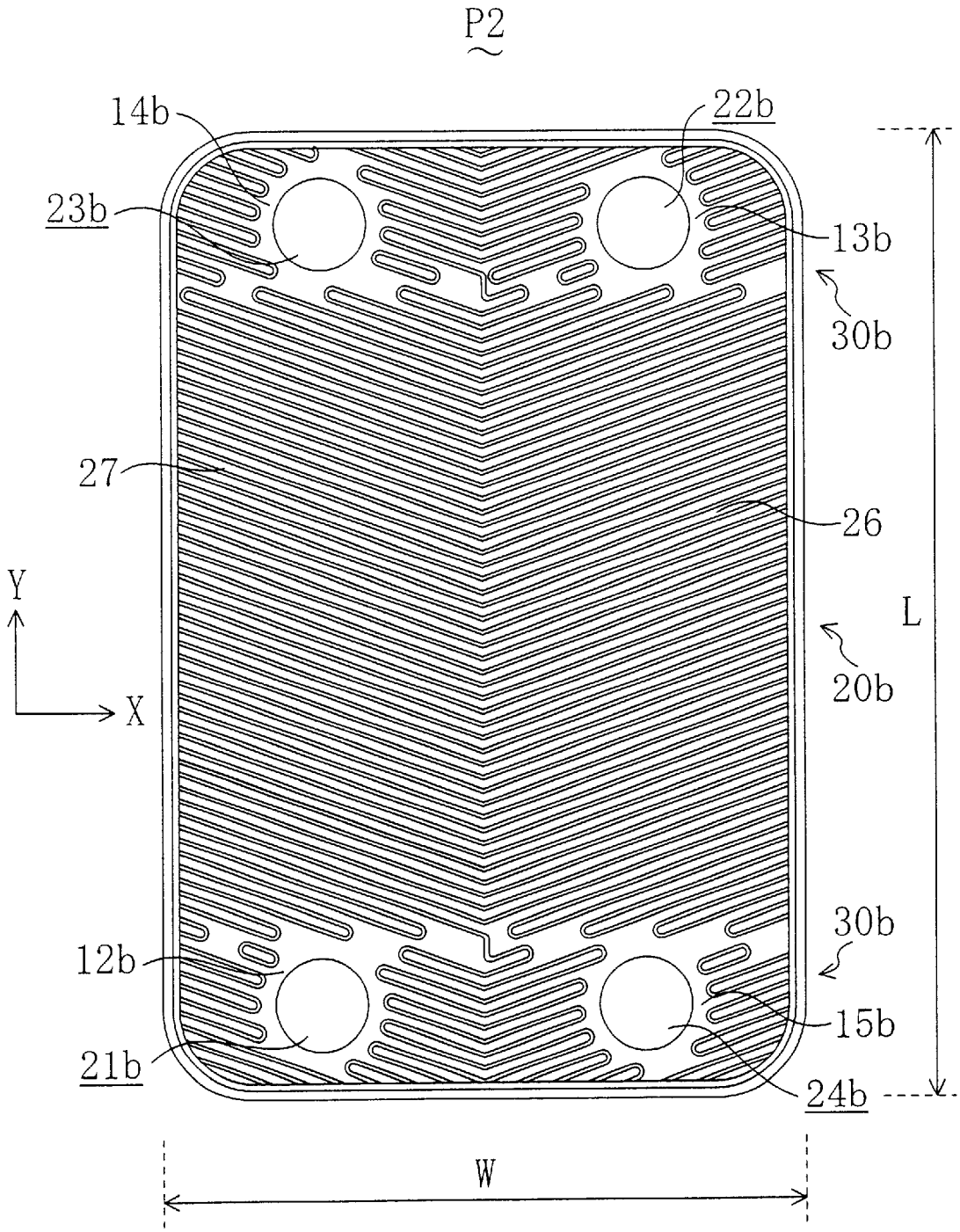
FIG. 3 is a front view of a second heat transfer plate according to Embodiment 1.

As shown in FIGS. 2 and 3, each of the heat transfer plates (P1), (P2) is formed of a substantially rectangular plate made of metal (such as stainless steel or aluminium) and has heat transfer enhancement surfaces (20*a*), (20*b*), (30*a*), (30*b*) formed by press working on its surfaces. The peripheral edges of both the heat transfer plates (P1), (P2) are each entirely bent in a manner to be slightly broadened toward the end so that the peripheral edges can be overlapped one on another to form the side face of the plate-type heat exchanger (1) when all the heat transfer plates (P1), (P2) are piled. That is to say, the side face of the plate-type heat exchanger (1) is formed so the bent peripheral edges are overlapped one on another.

FIG. 2 shows the front face of the first heat transfer plate (P1), and FIG. 3 shows the front face of the second heat transfer plate (P2). The peripheral edges of both the heat transfer plates (P1), (P2) are bent from their back side toward the front side. The first heat transfer plate (P1) and the second heat transfer plate (P2) are piled in a manner that the front face of one heat transfer plate is opposed to the back face of the other. Between the front face of the first heat transfer plate (P1) and the back face of the second heat transfer plate (P2), the first flow channel (A) through which the first fluid flows is formed. On the other hand, between the back face of the first heat transfer plate (P1) and the front face of the second heat transfer plate (P2), the second flow channel (B) through which the second fluid flows is formed.

Aspect Ratio of Heat Transfer plate (P1), (P2)

As a characteristic of the present invention, the aspect ratio of each heat transfer plate (P1), (P2) is set at a value of 2 or less. Particularly in this embodiment, the aspect ratio is set at 1.5. That is to say, as shown in FIGS. 2 and 3, each heat transfer plate (P1), (P2) is formed so that its longitudinal length (in a direction Y) is 1.5 times the lateral length (in a direction X).

In the conventional plate-type heat exchangers, their aspect ratio is more than 2. In contrast, in the plate-type heat exchanger (1) of this embodiment, the lateral length of the heat transfer plate is increased and the longitudinal length thereof is decreased as compared with the conventional one. This decreases the aspect ratio while keeping the heat transfer area substantially constant. In this manner, each of the first flow channel (A) and the second flow channel (B) can increase its width and decrease its length without decreasing its heat transfer area. In other words, the cross section of the flow channel can be increased and the length thereof can be decreased so that a pressure loss of the fluid in the flow channel can be reduced.

The principle of setting the aspect ratio in the present invention will be now described comparing the performances of the conventional plate-type heat exchanger (conventional example) having an aspect ratio of 4.7 and the plate-type heat exchanger according to the present invention.

Figure 4:
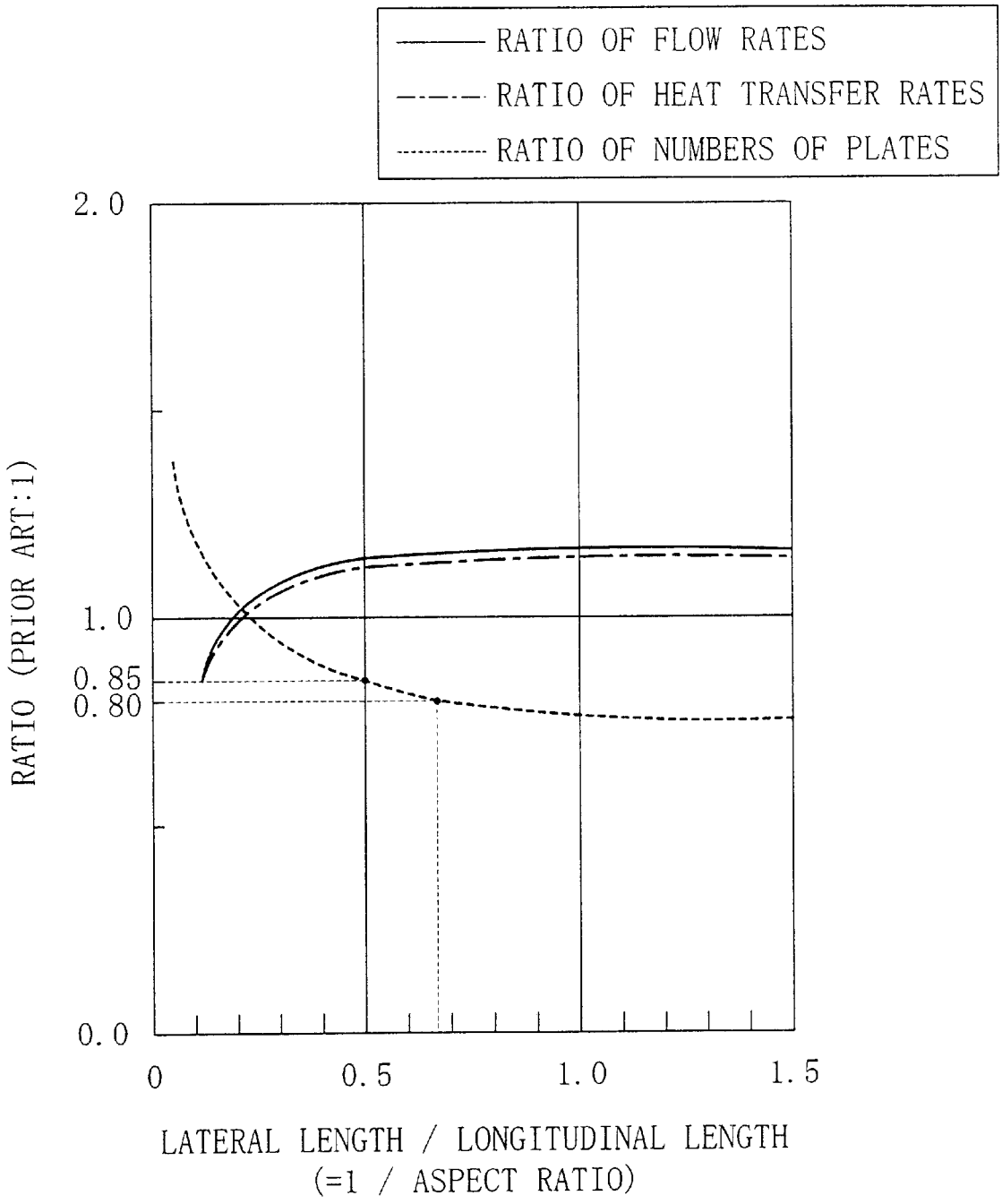
FIG. 4 is a graph showing performance comparison between inventive and conventional examples in which the inverse of an aspect ratio is used as a parameter.

FIG. 4 shows calculation results of the ratio of flow rates, the ratio of heat transfer coefficients and the ratio of necessary numbers of heat transfer plates of the inventive heat exchanger with respect to the conventional example when the inverse of the aspect ratio of the heat transfer plate is used as a parameter and the pressure loss in the flow channel is assumed to be equal with each other.

As is evident from FIG. 4, as the aspect ratio is decreased (as the inverse of the aspect ratio is increased), the ratio of flow rates and the ratio of heat transfer coefficients become larger. On the other hand, as the aspect ratio is decreased, i.e., as the heat transfer plate is increased in its lateral length, the necessary number of heat transfer plates becomes smaller.

As can be understood from the above, if the inverse of the aspect ratio is gradually increased from about 0.2 (prior art), the ratio of flow rates and the ratio of heat transfer coefficients tend to abruptly rise until the inverse reaches 0.5 and then ease their rates of rise when the inverse exceeds 0.5.

Further, if the inverse of the aspect ratio is gradually increased from 0.2, the necessary number of heat transfer plates abruptly decreases in correspondence with the abrupt increases of the ratio of flow rates and the ratio of heat transfer coefficients, eases its rate of decrease when the inverse exceeds 0.5, and then seldom decreases when the inverse exceeds 1.

In view of such tendencies, in the present invention, the inverse of the aspect ratio is set at 0.5 or more at which the ratio of flow rates and the necessary number of heat transfer plates are not substantially changed. In other words, the aspect ratio is set at 2 or less.

On the contrary, if the aspect ratio is decreased, the width of the flow channel is increased thereby easily causing a drift of the fluid. Therefore, in order to effectively reduce a pressure loss of the fluid while suppressing a drift thereof, it is most preferable that the aspect ratio is not smaller than 1 and not larger than 2.

Specifically, when the aspect ratio is 2 (the inverse of the aspect ratio is 0.5), the ratio of necessary numbers of heat transfer plates is 0.85, which means that the necessary number can be reduced by about 15%. In the plate-type heat exchanger (1) of the foregoing embodiment, since the aspect ratio is 1.5, the ratio of necessary numbers of heat transfer plates is 0.80, which means that the necessary number can be reduced by about 20%. By setting the aspect ratio at 2 or less as described above, the present invention can reduce the necessary number of heat transfer plates by 15% or more as compared with the prior art.

Details of Structure of Heat Transfer Plate (P1), (P2)

As shown in FIGS. 2 and 3, in each of the first heat transfer plate (P1) and the second heat transfer plate (P2), the first opening (21*a*), (21*b*), the second opening (22*a*), (22*b*), the third opening (23*a*), (23*b*) and the fourth opening (24*a*), (24*b*) each having a circular shape are formed at the four corners, i.e., the lower left corner, the upper right corner, the upper left corner and the lower right corner, respectively.

Around the openings (21*a*), (21*b*) through (24*a*), (24*b*), respective planar seals (12*a*), (12*b*) through (15*a*), (15*b*) are formed to surround the openings (21*a*), (21*b*) through (24*a*), (24*b*) and rise toward the front side or back side of the heat transfer plate (P1), (P2).

Specifically, as shown in FIG. 2, in the first heat transfer plate (P1), the seal (12*a*) surrounding the first opening (21*a*) and the seal (13*a*) surrounding the second opening (22*a*) rise from the front side toward the back side. On the contrary, the seal (14*a*) surrounding the third opening (23*a*) and the seal (15*a*) surrounding the fourth opening (24*a*) rise from the back side toward the front side.

On the other hand, in the second heat transfer plate (P2), the seals (12*b*), (13*b*) respectively surrounding the first opening (21*b*) and the second opening (22*b*) rise from the back side toward the front side. On the contrary, the seals (14*b*), (15*b*) respectively surrounding the third opening (23*b*) and the fourth opening (24*b*) rise from the front side toward the back side.

When the first heat transfer plate (P1) and the second heat transfer plate (P2) are engaged and joined with each other at the seals (12*a*), (12*b*) through (15*a*), (15*b*), the second fluid is prevented from flowing into the first flow channel (A) and the first fluid is prevented from flowing into the second flow channel (B). In addition, the first inflow space (8) and the first outflow space (9) are communicated with the first flow channel (A), and the second inflow space (10) and the second outflow space (11) are communicated with the second flow channel (B). As a result, the first fluid can flow through the first flow channel (A) and the second fluid can flow through the second flow channel (B).

The remaining portion of the heat transfer plate (P1), (P2) is formed into a heat transfer enhancement surface (20*a*), (20*b*), (30*a*), (30*b*). In detail, a primary heat transfer enhancement surface (20*a*), (20*b*) is formed in the longitudinal midportion of the heat transfer plate (P1), (P2), while auxiliary heat transfer enhancement surfaces (30*a*), (30*b*) are formed at both longitudinal ends of the heat transfer plate (P1), (P2). The auxiliary heat transfer enhancement surface (30*a*), (30*b*) is formed over a space between the seals (12*a*), (12*b*) through (15*a*), (15*b*) and the primary heat transfer enhancement surface (20*a*), (20*b*).

The heat transfer enhancement surface (20*a*), (20*b*), (30*a*), (30*b*) is a portion for enhancing heat exchange by giving disturbance to the flow of each fluid. The heat transfer enhancement surface (20*a*), (20*b*), (30*a*), (30*b*) is formed in such a wave shape that ridges and valleys are alternately repeated in the longitudinal direction of the heat transfer plate (P1), (P2). The heat transfer enhancement surface (20*a*), (20*b*), (30*a*), (30*b*) has a so-called herringbone form including an upwardly inclined section (26) and a downwardly inclined section (27) in which the extending direction of the ridges and valleys is inclined upwardly and downwardly toward the right hand of the figure, respectively.

The primary heat transfer enhancement surface (20*a*), (20*b*) is formed in the longitudinal midportion of the heat transfer plate (P1), (P2) to enhance heat exchange by giving disturbance to the flow of each fluid vertically flowing on the heat transfer plate (P1), (P2). On the other hand, the auxiliary heat transfer enhancement surface (30*a*), (30*b*) enhances heat exchange by giving disturbance to the fluid diverging from each of the inlets (21*a*), (21*b*), (23*a*), (23*b*) toward the primary heat transfer enhancement surface (20*a*), (20*b*) or the fluid converging from the primary heat transfer enhancement surface (20*a*), (20*b*) toward each of the outlets (22*a*), (22*b*), (24*a*), (24*b*).

The first heat transfer plate (P1) and the second heat transfer plate (P2) are different from each other in the extending directions of the ridges and valleys of the heat transfer enhancement surfaces (20*a*), (20*b*), (30*a*), (30*b*). Specifically, as shown in FIG. 2, in the first heat transfer plate (P1), the upwardly inclined section (26) is formed in the left half, and the downwardly inclined section (27) is formed in the right half. On the contrary, as shown in FIG. 3, in the second heat transfer plate (P2), the downwardly inclined section (27) is formed in the left half, and the upwardly inclined section (26) is formed in the right half.

When the first heat transfer plate (P1) is joined to the second heat transfer plate (P2), the ridges of one heat transfer plate engages the valleys of the other, so that a zigzag flow channel (A), (B) is formed between the adjacent heat transfer plates (P1), (P2).

Heat Exchange Operation

Next, description will be made about a heat exchange operation between the first and second fluids in the plate-type heat exchanger (1). Here, fluorocarbon refrigerant involving a phase change during heat exchange, such as R407C, is used as the first and second fluids.

As shown in solid arrows in FIG. 1, a first refrigerant in low-temperature gas-liquid two-phase condition flows into each of the first flow channels (A), (A), . . . from the first inlet pipe (4) through the first inflow space (8). On the other hand, a second refrigerant in high-temperature gas condition flows into the second flow channels (B), (B), . . . from the second inlet pipe (6) through the second inflow space (10).

The first refrigerant flowing through the first flow channel (A) is heat-exchanged with the second refrigerant flowing through the second flow channel (B) via the heat transfer plate (P1), (P2). As a result, the first refrigerant is evaporated and the second refrigerant is condensed. Then, the first refrigerant evaporated in gas condition flows out from the first outlet pipe (5) through the first outflow space (9). On the other hand, the second refrigerant condensed in liquid condition flows out from the second outlet pipe (7) through the second outflow space (11).

Effects of this Embodiment

According to the plate-type heat exchanger (1) of this embodiment, since the aspect ratio of the heat transfer plate (P1), (P2) is small, each of the first flow channel (A) and the second flow channel (B) has a large channel cross-sectional area and a short channel length. Therefore, a pressure loss of each refrigerant in the flow channels (A), (B) is small. Accordingly, a pressure loss of each refrigerant can be reduced without increasing the number of heat transfer plates.

Since the pressure loss is reduced in such a manner, a circulation driving force required for circulating each refrigerant can be decreased, which enhances the efficiency of an apparatus in which the heat exchanger is mounted.

Further, since the pressure loss is small, temperature change of each refrigerant in the flow channels (A), (B) is small. Therefore, decrease in efficiency of heat exchange can be suppressed.

As can be understood from the above, the plate-type heat exchanger (1) of this embodiment can be mounted even in air conditioners and the like having severe constrains on pressure loss. Accordingly, the plate-type heat exchanger (1) of this embodiment can be mounted even in apparatuses in which refrigerant is circulated by a small-capacity pump, i.e., such apparatuses that the conventional plate-type heat exchanger would be hard to incorporate therein. For example, in an air conditioning system in which heat transfer is made by using refrigerant as a medium in the intermediate stage, the effects of this invention can be remarkably exerted. Thus, the plate-type heat exchanger (1) of this embodiment can broaden the range of air conditioners in which it can be mounted.

EMBODIMENT 2

A plate-type heat exchanger according to Embodiment 2 comprises drift suppressing rib sets (50*a*), (50*b*), (60*a*), (60*b*) for suppressing a drift of the refrigerant in the flow channel (A), (B).

Figure 5:
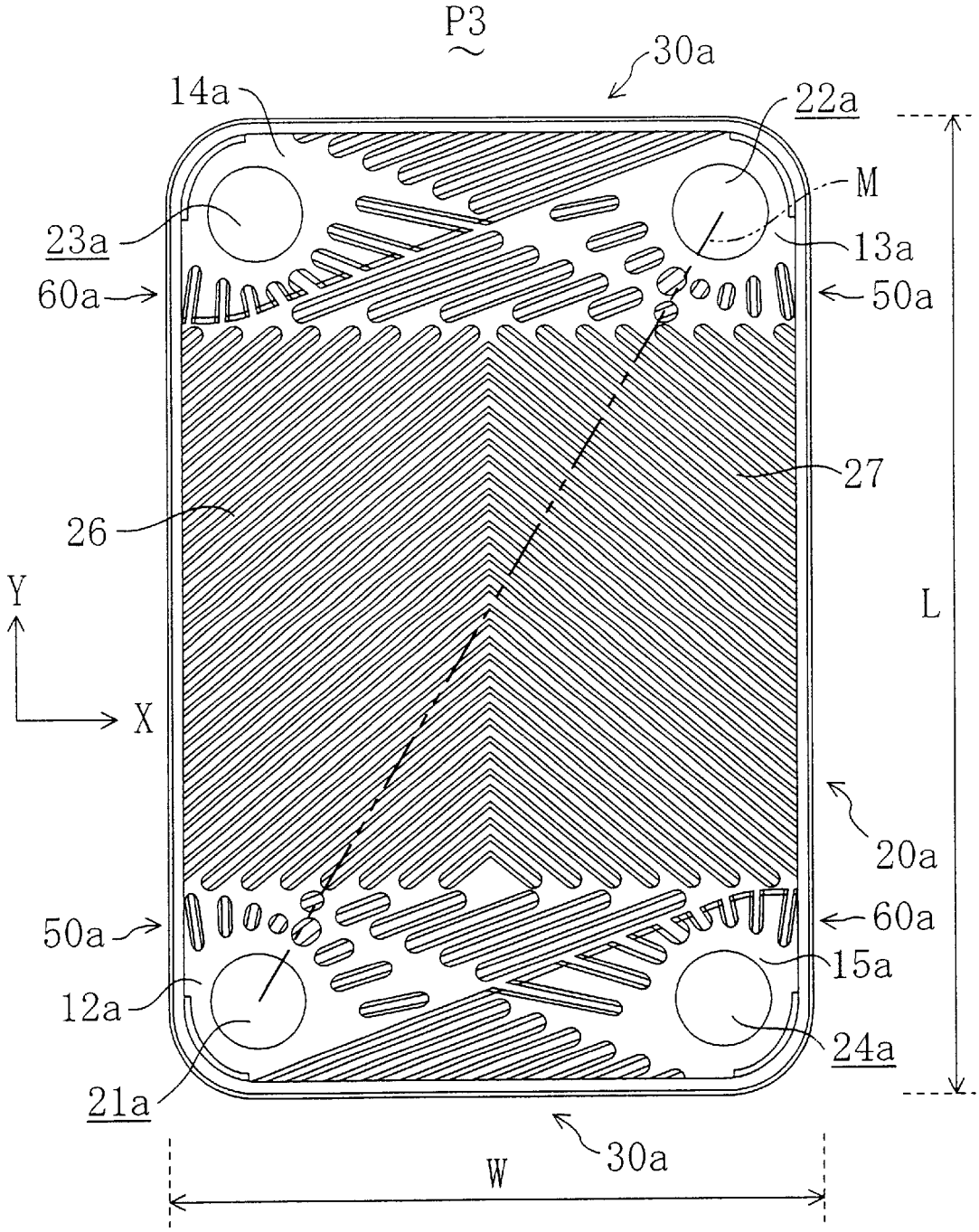
FIG. 5 is front view of a first heat transfer plate according to Embodiment 2.
Figure 6:
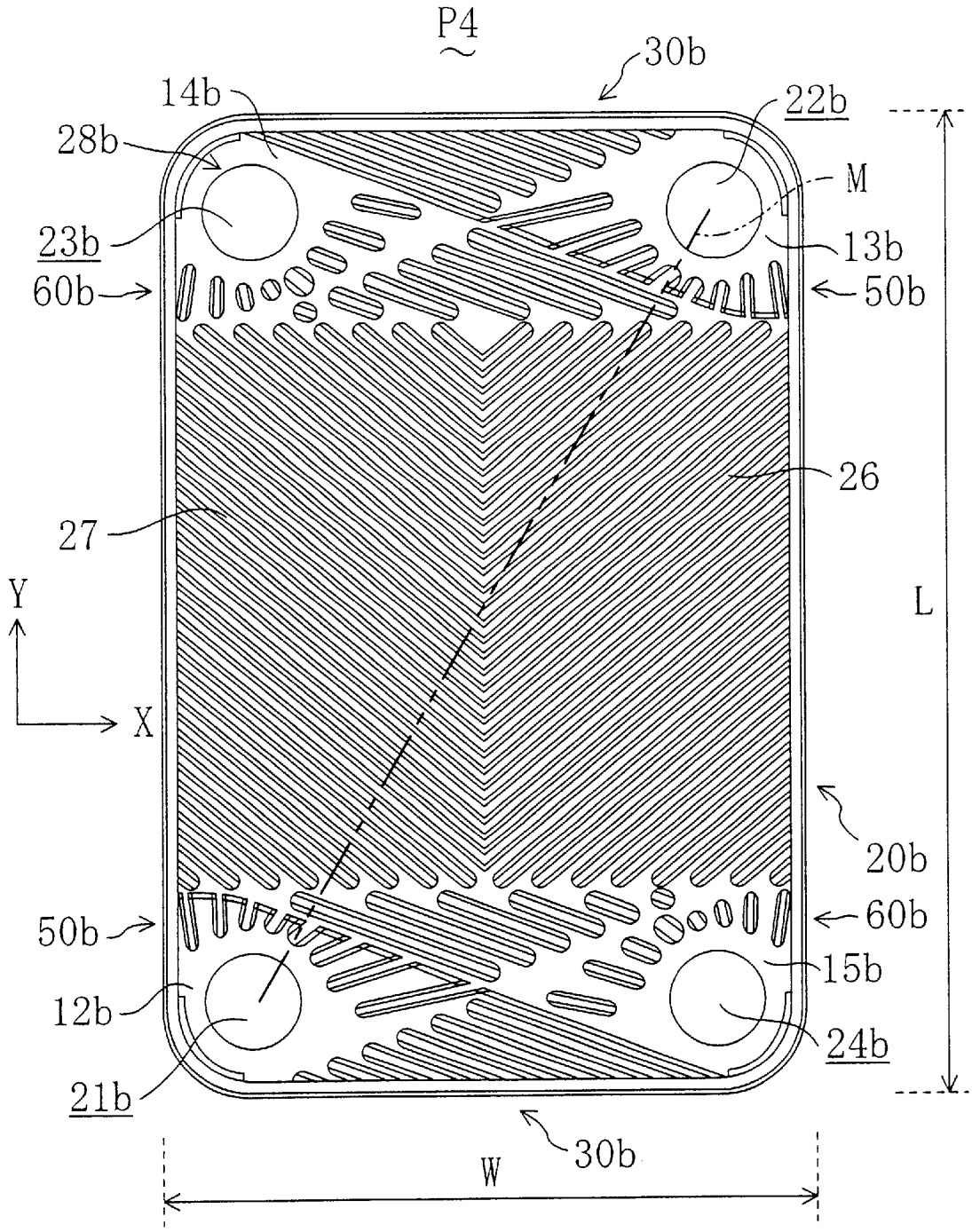
FIG. 6 is a front view of a second heat transfer plate according to Embodiment 2.

The plate-type heat exchanger according to Embodiment 2 has a construction that the first heat transfer plate (P1) and the second heat transfer plate (P2) in the plate-type heat exchanger (1) of Embodiment 1 are replaced with a first heat transfer plate (P3) shown in FIG. 5 and a second heat transfer plate (P4) shown in FIG. 6, respectively. Since portions other than the heat transfer plates (P3), (P4) are the same as those of Embodiment 1, description will be herein made about the heat transfer plates (P3), (P4) alone and description of the other portions will be omitted.

Structure of Heat Transfer Plate

As shown in FIGS. 5 and 6, in each of the first heat transfer plate (P3) and the second heat transfer plate (P4), the first opening (21*a*), (21*b*), the second opening (22*a*), (22*b*), the third opening (23*a*), (23*b*) and the fourth opening (24*a*), (24*b*) each having a circular shape are formed, like Embodiment 1, at the four corners, i.e., the lower left corner, the upper right corner, the upper left corner and the lower right corner, respectively.

Around the openings (21*a*), (21*b*) through (24*a*), (24*b*), respective planar seals (12*a*), (12*b*) through (15*a*), (15*b*) rising toward the front side or back side and drift suppressing rib sets (50*a*), (50*b*), (60*a*), (60*b*) each including a plurality of ribs (51) through (58) formed in the vicinity of the seals (12*a*), (12*b*) through (15*a*), (15*b*) are provided.

In the midportion of each heat transfer plate (P3), (P4) in a longitudinal direction (in a direction Y of the figure), a primary heat transfer enhancement surface (20*a*), (20*b*) including a plurality of wave-shaped ridges is formed. At both longitudinal ends of the heat transfer plate, auxiliary heat transfer enhancement surfaces (30*a*), (30*b*) are formed. The auxiliary heat transfer enhancement surface (30*a*), (30*b*) is formed between the primary heat transfer enhancement surface (20*a*), (20*b*) and the seals (12*a*), (12*b*) through (15*a*), (15*b*).

Details of the structure of the seal, the heat transfer enhancement surface and the drift suppressing rib set will be described below.

Structure of Seal

As shown in FIG. 5, in the first heat transfer plate (P3), the seal (12*a*) surrounding the first opening (21*a*) and the seal (13*a*) surrounding the second opening (22*a*) rise from the front side toward the back side. On the contrary, the seal (14*a*) surrounding the third opening (23*a*) and the seal (15*a*) surrounding the fourth opening (24*a*) rise from the back side toward the front side. On the other hand, as shown in FIG. 6, in the second heat transfer plate (P4), the seals (12*b*), (13*b*) respectively surrounding the first opening (21*b*) and the second opening (22*b*) rise from the back side toward the front side. On the contrary, the seals (14*b*), (15*b*) respectively surrounding the third opening (23*b*) and the fourth opening (24*b*) rise from the front side toward the back side. When the first heat transfer plate (P3) and the second heat transfer plate (P4) are joined together at the raised portions, the second fluid is prevented from flowing into the first flow channel (A) defined between the front face of the first heat transfer plate (P3) and the back face of the second heat transfer plate (P4) so that the first fluid alone can flow through the first flow channel (A). Likewise, the first fluid is prevented from flowing into the second flow channel (B) defined between the back face of the first heat transfer plate (P3) and the front face of the second heat transfer plate (P4) so that the second fluid alone can flow through the second flow channel (B).

Structure of Heat Transfer Enhancement Surface

Like Embodiment 1, the primary heat transfer enhancement surface (20*a*), (20*b*) has a so-called herringbone form including an upwardly inclined section (26) and a downwardly inclined section (27).

On the other hand, the auxiliary heat transfer enhancement surface (30*a*) of the first heat transfer plate (P3) is formed of only an upwardly inclined section in which the ridges and valleys are inclined upwardly toward the right hand of the figure. And, the auxiliary heat transfer enhancement surface (30*b*) of the second heat transfer plate (P4) is formed of only a downwardly inclined section in which the ridges and valleys are inclined downwardly toward the right hand of the figure.

As a characteristic of this embodiment, the primary heat transfer enhancement surface (20*a*), (20*b*) is formed so that the ratio between the longitudinal and lateral lengths is substantially 1. In other words, the primary heat transfer enhancement surface (20*a*), (20*b*) is formed so that the longitudinal length is substantially equal to the lateral length. Accordingly, the longitudinal length is smaller than two times the lateral length.

Structure of Drift Suppressing Rib Set

Next, the structure of the drift suppressing rib set will be described.

As shown in FIG. 5, first drift suppressing rib sets (50*a*) each consisting of eight ribs (51) through (58) rising from the back side toward the front side are formed above the first opening (21*a*) of the seal (12*a*) of the first heat transfer plate (P3) and below the second opening (22*a*) of the seal (13*a*), respectively. On the other hand, second drift suppressing rib sets (60*a*) each consisting of eight ribs (51) through (58) rising from the front side toward the back side are formed below the third opening (23*a*) of the seal (14*a*) and above the fourth opening (24*a*) of the seal (15*a*), respectively.

Since the drift suppressing rib sets (50*a*), (50*b*) are of symmetric configuration, only the structure of the first drift suppressing rib set (50*a*) provided around the first opening (21*a*) will be described herein.

Figure 7:
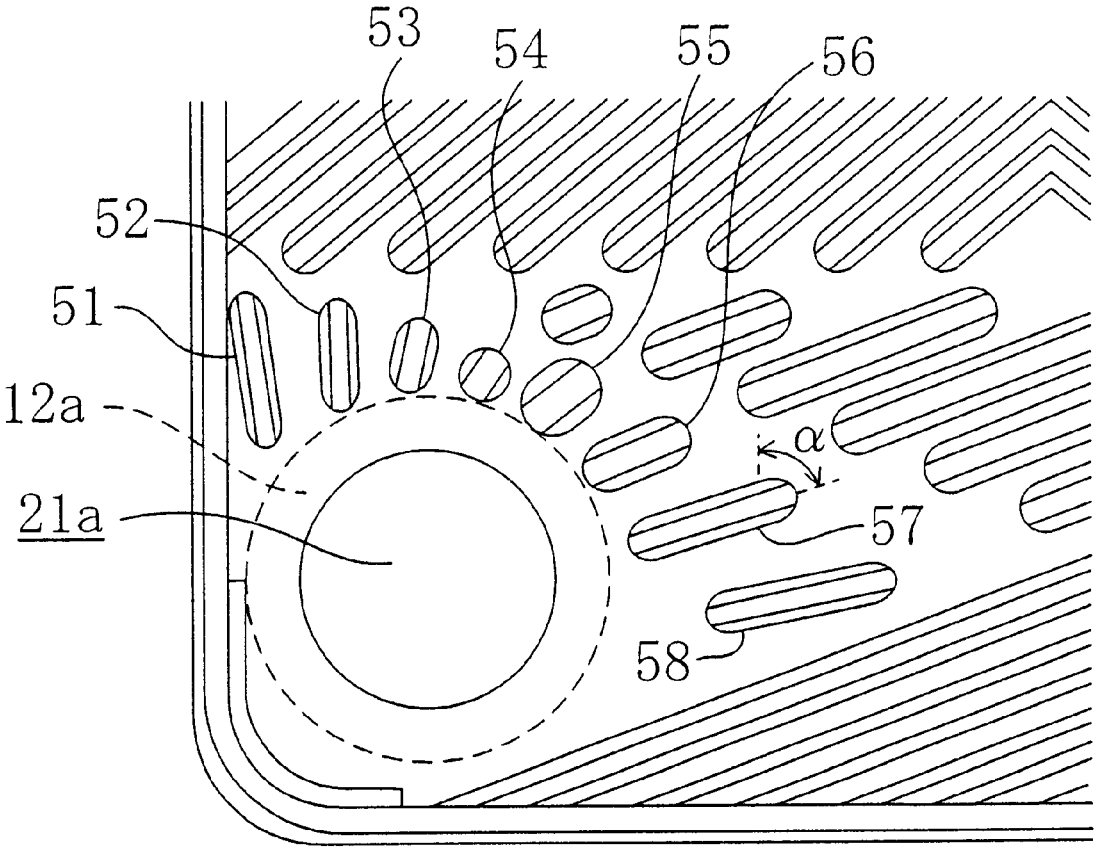
FIG. 7 is a partly enlarged front view of a heat transfer plate showing the arrangement of a drift suppressing rib set.

As shown in FIG. 7, the first drift suppressing rib set (50*a*) is composed of a first rib (51), a second rib (52), a third rib (53), a fourth rib (54), a fifth rib (55), a sixth rib (56), a seventh rib (57) and an eighth rib (58) provided in this order from the left to surround the first opening (21*a*) from above. The plurality of ribs (51) through (58) are arranged substantially radially around the first opening (21*a*) so as to smoothly and uniformly introduce the first fluid flowing into the first flow channel (A) through the first opening (21*a*) toward the primary heat transfer enhancement surface (20*a*). Specifically, each of the ribs (51) through (58) is inclined with respect to the vertical axis so that the angle $\alpha$ formed clockwise between each rib and the vertical direction gradually increases in the order from the first rib (51) to the eighth rib (58).

Each of the ribs (51) through (58) is formed so that the lengthwise direction thereof extends substantially radially from the center of the first opening (21*a*). The ribs (51) through (58) are different in length from one another depending upon the distances between their respective locations and both the first opening (21*a*) and the primary heat transfer enhancement surface (20*a*). For example, the first rib (51) and the eighth rib (58) provided at locations farther from the first opening (21*a*) and the heat transfer enhancement surface (20*a*) are formed longer, while the fourth rib (54) provided at a location closer to them is formed shorter. Specifically, the length of the rib is gradually decreased in the order from the first rib (51) to the fourth rib (54) and gradually increased in the order from the fourth rib (54) to the eighth rib (58).

The width of the rib (51) through (58) is gradually increased in the order from the first rib (51) to the fourth rib (54) and gradually decreased in the order from the fourth rib (54) to the eighth rib (58). Accordingly, the fourth rib (54) located midway between the ribs (51) and (58) has a largest width, and the first rib (51) and the eighth rib (58) located at both ends have a smallest width. In other words, the width of the rib is large at the midpoint close to an imaginary line M connecting the first opening (21*a*) with the second opening (22*a*) and is small at both the ends far from the imaginary line M.

The intervals between respective adjacent two of the ribs (51) through (58) are set irregularly taking into account flow characteristics of the two-phase flow. That is to say, the plurality of ribs (51) through (58) are arranged at irregular intervals so that the refrigerant flowing thereinto in two-phase condition is introduced uniformly to the primary heat transfer enhancement surface (20*a*). Specifically, at a location where the refrigerant is easy to flow thereinto from the first opening (21*a*) such as the midpoint between the ribs (51) and (58), the interval between the ribs is small. On the other hand, at locations where the refrigerant is hard to flow thereinto from the first opening (21*a*) such as both ends, the interval between the ribs is large. With this arrangement, the plurality of ribs (51) through (58) can introduce a larger amount of refrigerant to the primary heat transfer enhancement surface (20*a*) at the locations where the refrigerant is hard to flow, and concurrently can suppress an excessive flow of refrigerant at the location where the refrigerant is easy to flow, thereby suppressing a drift. Furthermore, a valley between the seventh rib (57) and the eighth rib (58) is formed at the largest interval since the refrigerant is least likely to flow.

The drift suppressing rib sets (50*b*), (60*b*) of the second heat transfer plate (P4) have respective rising directions opposite to the drift suppressing rib sets (50*a*), (60*a*) of the first heat transfer plate (P3), and other structures are the same.

Heat Exchange Operation

As shown in solid arrows in FIG. 1 like Embodiment 1, a first refrigerant in low-temperature gas-liquid two-phase condition flows into each of the first flow channels (A, A, . . . ) from the first inlet pipe (4) through the first inflow space (8). At the time, the first refrigerant is uniformly introduced to the heat transfer enhancement surface (20*a*), (20*b*) by the drift suppressing rib set (50*a*), (50*b*). On the other hand, a second refrigerant in high-temperature gas condition flows into the second flow channels (B, B, . . . ) from the second inlet pipe (6) through the second inflow space (10). At the time, the second refrigerant is also introduced uniformly to the heat transfer enhancement surface (20*a*), (20*b*) by the drift suppressing rib set (60*a*), (60*b*).

The first refrigerant flowing through the first flow channel (A) is heat-exchanged with the second refrigerant flowing through the second flow channel (B) via the heat transfer plate (P3), (P4). As a result, the first refrigerant is evaporated and the second refrigerant is condensed. Then, the first refrigerant evaporated in gas condition flows out from the first outlet pipe (5) through the first outflow space (9). On the other hand, the second refrigerant condensed in liquid condition flows out from the second outlet pipe (7) through the second outflow space (11).

Effects of Embodiment 2

If the aspect ratio of the heat transfer plate (P3), (P4) is decreased, this may cause fears of deterioration in heat exchange performance due to a drift of refrigerant in the flow channels (A), (B). In Embodiment 2, however, since the drift suppressing rib sets (50*a*), (50*b*), (60*a*), (60*b*) are provided, a drift of refrigerant in the flow channel (A), (B) can be sufficiently suppressed. Therefore, the aspect ratio can be decreased. Accordingly, a pressure loss of refrigerant can be further reduced.

Particularly, refrigerant flowing in gas-liquid two-phase condition easily causes a drift in the flow channel due to difference in specific gravity between its gas and liquid phases. According to this embodiment, however, adrift can be effectively suppressed. Therefore, the fluid flowing in gas-liquid two-phase condition can be well heat-exchanged.

Furthermore, since the plurality of ribs (51) through (58) constituting the drift suppressing rib set (50*a*), (50*b*), (60*a*) (60*b*) are arranged at such irregular intervals that the interval between the ribs (53) through (56) intermediate the ends of the rib set is narrower than that between the ribs (51), (52), (57), (58) closer to the ends of the rib set. Therefore, the flow path for the fluid at the location intermediate the ends of the rib set is narrower, while the flow paths for the fluid at the locations closer to the ends are broader. This suppresses an excessive flow of the fluid at the intermediate location and accelerates the flow of the fluid at the locations closer to the ends. Accordingly, a drift of the fluid can securely be suppressed.

Figure 9:
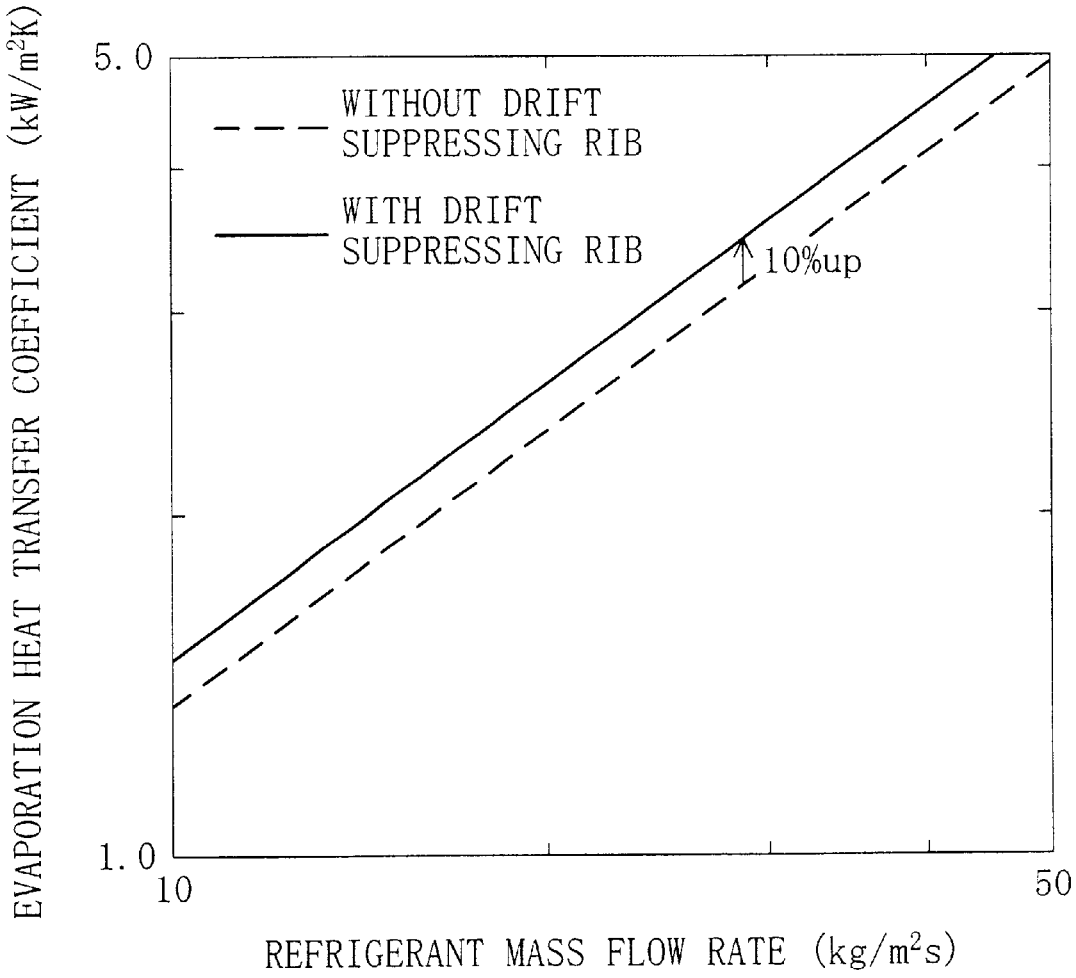
FIG. 9 is a graph showing the relationship between the mass flow rate of refrigerant and the evaporation heat transfer coefficient.
Figure 10:
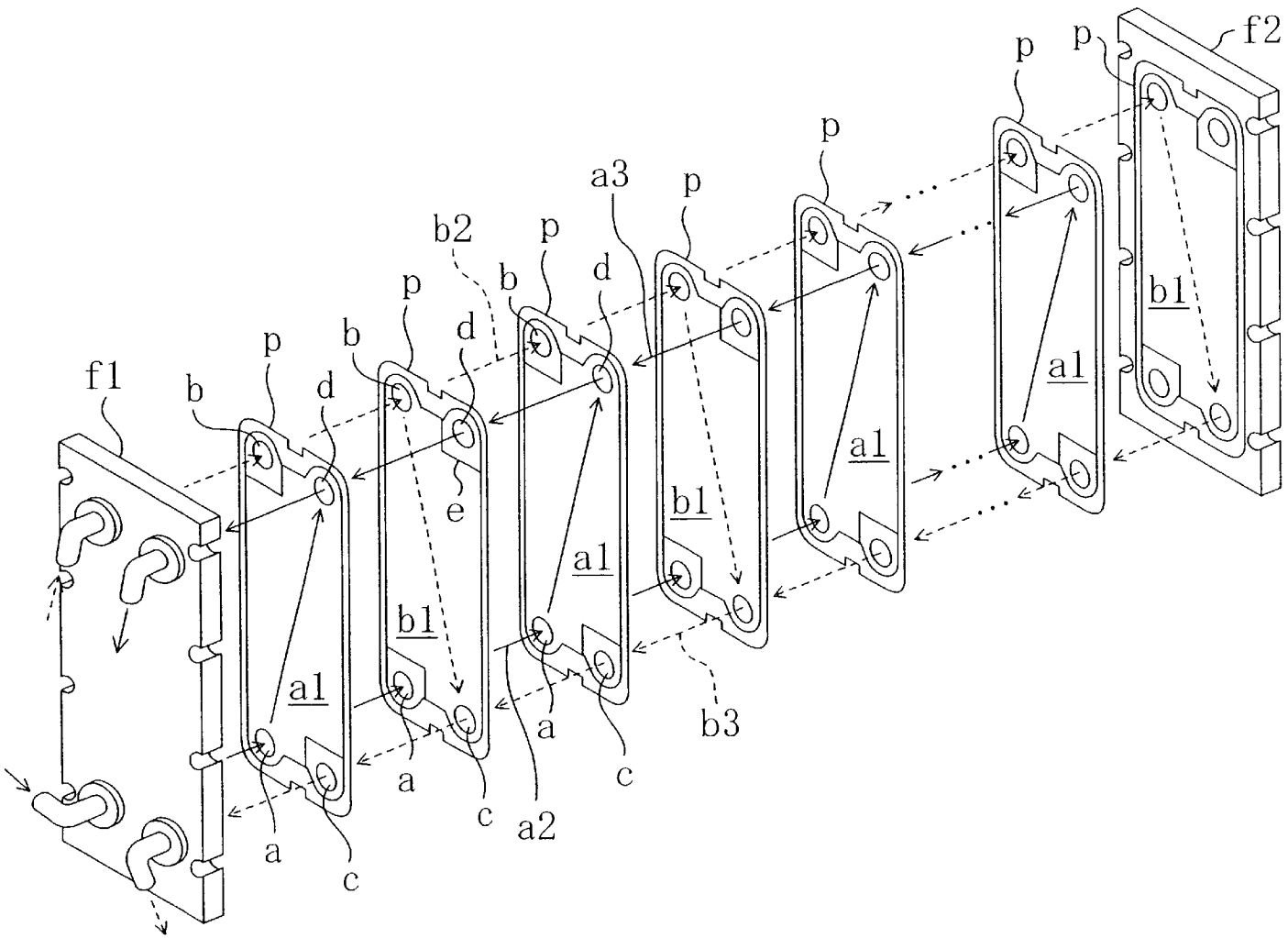
FIG. 10 is an exploded perspective view of a conventional plate-type heat exchanger.

FIG. 9 is a graph showing a comparison of evaporation heat transfer coefficient relative to mass flow rate of refrigerant for this embodiment provided with the drift suppressing rib sets (50*a*), (50*b*), (60*a*), (60*b*) and the plate-type heat exchanger provided with no drift suppressing rib set. As can be seen from FIG. 9, according to this embodiment provided with the drift suppressing rib sets (50*a*), (50*b*), (60*a*), (60*b*), the evaporation heat transfer coefficient is increased by about 10% as compared with the plate-type heat exchanger provided with no drift suppressing rib set.

Other Embodiments

Figure 8:
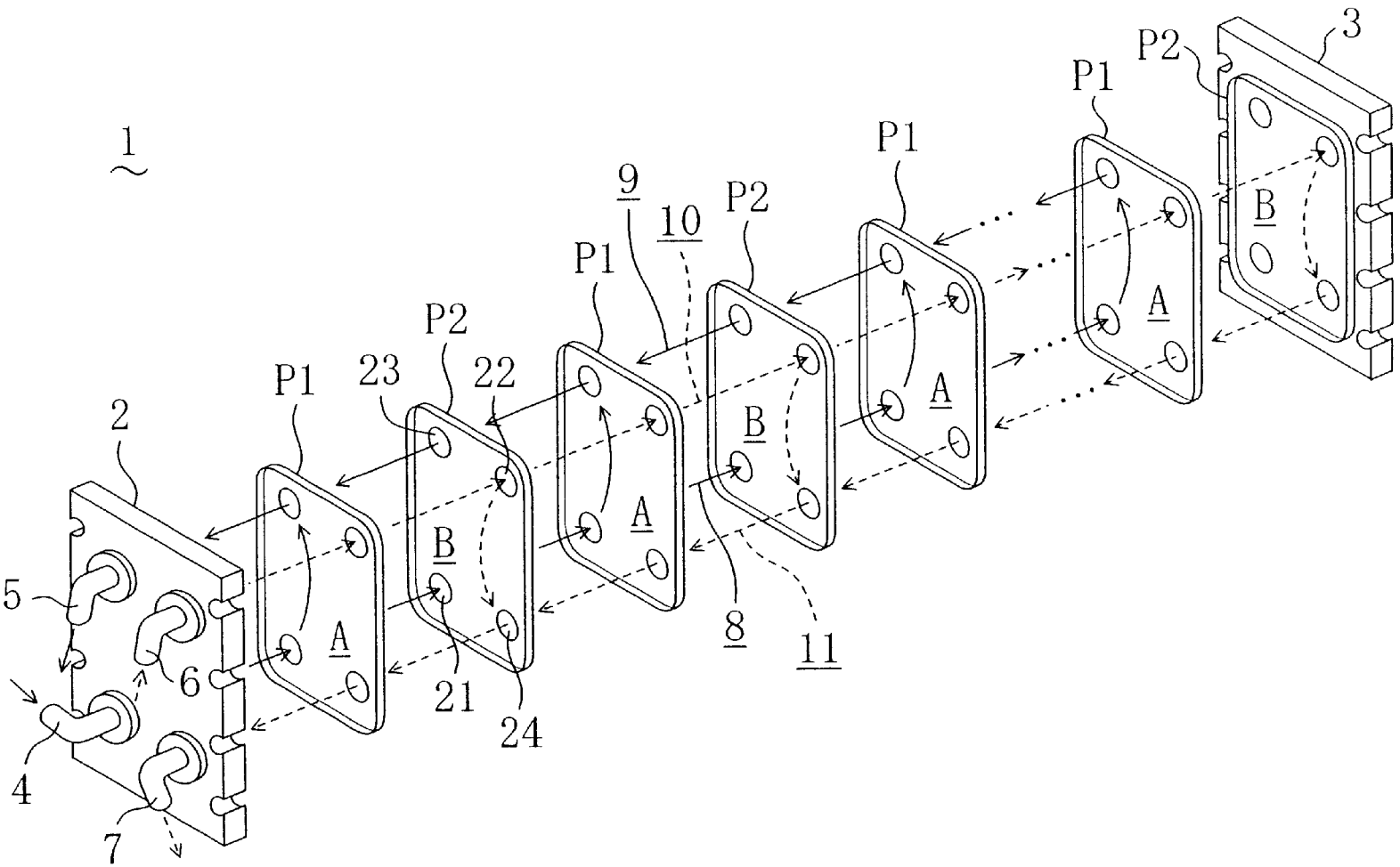
FIG. 8 is an exploded perspective view of a plate-type heat exchanger according to another embodiment.

The foregoing embodiments use a manner in which the first and second fluids flow along the diagonal of the heat transfer plate (P1), (P2), (P3), (P4). The manner in which each fluid flows, however, is not limited to the above manner. For example, as shown in FIG. 8, the first opening (21) and the third opening (23) may be used as an inlet and outlet of the first fluid, respectively, and the second opening (22) and the fourth opening (24) may be used as an inlet and outlet of the second fluid, respectively. That is to say, the inlet and outlet of each fluid may be formed to be parallel with each other. If such a manner is utilized, a plate-type heat exchanger can be constructed by simply piling a plurality of heat transfer plates of one type while alternately turning them upside down. As a result, only a single type of press die is required to form heat transfer plates for the heat exchanger by press working. This make it possible to reduce the production cost of the heat exchanger.

The first and second fluids are not limited to R407C and maybe other refrigerants. Further, the first and second fluids may be made of a fluid involving no phase change during heat exchange, for example, water or brine.

The aspect ratio of the heat transfer plate (P1) through (P4) is not limited to 1.5 and may be at any value of 2 or less.

Industrial Applicability

As described so far, the present invention is useful as a heat exchanger for air conditioning systems, refrigerating systems, chilling systems or the like.

What is claimed is:

1. A plate-type heat exchanger in which a first flow channel or a second flow channel is formed between adjacent two of plural piled heat transfer plates, the first and second flow channels allow respective first and second fluids to flow therethrough in a longitudinal direction of the heat transfer plate and the first and second fluids are heat-exchanged with each other via the heat transfer plates, wherein each of the heat transfer plate is formed so that a longitudinal length thereof is equal to or smaller than two times a lateral length thereof, and wherein around an inlet of the at least one flow channel formed in each of the heat transfer plates, a drift suppressing rib set including a plurality of ribs is formed to introduce the fluid from the inlet uniformly into the flow channel.

2. The plate-type heat exchanger of claim 1, wherein each of the heat transfer plates is formed so that the longitudinal length thereof is not smaller than the lateral length thereof and not larger than two times the lateral length.

3. The plate-type heat exchanger of claim 1, wherein the inlet and the outlet of the first flow channel are provided in cater-cornered opposite positions of the heat transfer plate and the inlet and the outlet of the second flow channel are provided in another cater-cornered opposite positions of the heat transfer plate, and each of the heat transfer plates is provided with:

seals, formed to surround the inlet and the outlet of each of the flow channels and rise on the front side or back side of the heat transfer plate, for preventing the first and second fluids from flowing into the second flow channel and the first flow channel, respectively, by engaging one of the adjacent heat transfer plates;

a primary heat transfer enhancement surface, formed in a longitudinal midportion of the heat transfer plate, for enhancing heat exchange by giving disturbance to the flow of each fluid vertically flowing on the heat transfer plate; and an auxiliary heat transfer enhancement surface, formed between the seals of the heat transfer plate and the primary heat transfer enhancement surface, for enhancing heat exchange by giving disturbance to the flow of the fluid diverging from the inlet toward the primary heat transfer enhancement surface or the flow of the fluid converging from the primary heat transfer enhancement surface toward the outlet.

4. The plate-type heat exchanger of claim 1, wherein the inlet and the outlet of the first flow channel are provided in cater-cornered opposite positions of the heat transfer plate and the inlet and the outlet of the second flow channel are provided in another cater-cornered opposite positions of the heat transfer plate, and each of the heat transfer plates is provided with:

seals, formed to surround the inlet and the outlet of each of the flow channels and rise on the front side or back side of the heat transfer plate, for preventing the first and second fluids from flowing into the second flow channel and the first flow channel, respectively, by engaging one of the adjacent heat transfer plates;

a primary heat transfer enhancement surface, formed in a longitudinal midportion of the heat transfer plate, for enhancing heat exchange by giving disturbance to the flow of each fluid vertically flowing on the heat transfer plate;

an auxiliary heat transfer enhancement surface, formed between the seals of the heat transfer plate and the primary heat transfer enhancement surface, for enhancing heat exchange by giving disturbance to the flow of the fluid diverging from the inlet toward the primary heat transfer enhancement surface or the flow of the fluid converging from the primary heat enhancement surface toward the outlet; and a plurality of ribs, formed around each of the inlets, for introducing the fluid flowing from each of the inlets uniformly in respective predetermined directions.

5. The plate-type heat exchanger of claim 1, wherein the plurality of ribs are arranged at irregular intervals so that an interval between the ribs intermediate the ends of the rib set is narrower than that between the ribs closer to the ends of the rib set.

6. The plate-type heat exchanger of claim 1, wherein at least one of the first fluid flowing through the first flow channel and the second fluid flowing through the second flow channel is a fluid for providing heat exchange involving a phase change.

* * * * *

UNITED STATES PATENT AND TRADEMARK OFFICE

CERTIFICATE OF CORRECTION

PATENT NO. : 6,394,178 B1 
DATED : May 28, 2002
INVENTOR(S) : Kaori Yoshida et al.

It is certified that error appears in the above-identified patent and that said Letters Patent is hereby corrected as shown below:

Title page,
Item [56], "References Cited", add -- 4,434,643 Almqvist et al. 03/06/84 --
-- 5,301,747 Daschmann et al. 04/12/94 --
-- 0 611 941 EP 08/24/94 --
-- 2 067 277 UK 07/22/81 --
-- WO 91/17406 PCT 11/14/91 --
-- WO 93/25860 PCT 12/23/93 --
-- Examiner: F. Mootz, Supplementary European Search Report, 4 pages, Date of search: 10/03/01, Place of search: The Hague --

Signed and Sealed this

Third Day of December, 2002

JAMES E. ROGAN
*Director of the United States Patent and Trademark Office*